US008955780B2

(12) United States Patent
Sato et al.

(10) Patent No.: US 8,955,780 B2
(45) Date of Patent: Feb. 17, 2015

(54) APPARATUS FOR FRACTURING AND METHOD FOR PRODUCING FRACTURED FRAGMENTS

(71) Applicant: Mitsubishi Materials Corporation, Tokyo (JP)

(72) Inventors: Motoki Sato, Naka-gun (JP); Ryusuke Tada, Naka-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 207 days.

(21) Appl. No.: 13/652,604

(22) Filed: Oct. 16, 2012

(65) Prior Publication Data

US 2013/0099031 A1 Apr. 25, 2013

(30) Foreign Application Priority Data

Oct. 21, 2011 (JP) ..... 2011-231975

(51) Int. Cl.

| | |
|---|---|
| ***B02C 23/00*** | (2006.01) |
| ***B02C 13/09*** | (2006.01) |
| ***B02C 13/20*** | (2006.01) |
| ***B02C 4/08*** | (2006.01) |
| ***B02C 4/30*** | (2006.01) |

(52) U.S. Cl.

CPC .... *B02C 4/08* (2013.01); *B02C 4/30* (2013.01)
USPC ..... 241/295; 241/189.1; 241/236

(58) Field of Classification Search

USPC ..... 241/294, 295, 235, 236, 300, 189.1, 241/187, 191

See application file for complete search history.

(56) References Cited

U.S. PATENT DOCUMENTS

| | | | | | |
|---|---|---|---|---|---|
| 3,412,946 | A | * | 11/1968 | Gabler et al. | 241/293 |
| 4,617,709 | A | * | 10/1986 | Gundlach | 241/293 |
| 5,704,561 | A | * | 1/1998 | Ansen et al. | 241/293 |
| 6,086,003 | A | * | 7/2000 | Gunter et al. | 241/235 |
| 6,094,795 | A | * | 8/2000 | Davenport | 29/407.1 |
| 7,198,209 | B2 | * | 4/2007 | Herbst | 241/30 |
| 7,950,600 | B2 | | 5/2011 | Gruebl et al. | |
| 8,240,589 | B2 | * | 8/2012 | Sommer et al. | 241/295 |

FOREIGN PATENT DOCUMENTS

| | | |
|---|---|---|
| JP | 2006-122902 A | 5/2006 |
| JP | 2006-192423 A | 7/2006 |
| JP | 2009-531172 A | 9/2009 |

* cited by examiner

*Primary Examiner* — Faye Francis
(74) *Attorney, Agent, or Firm* — Edwards Wildman Palmer LLP

(57) ABSTRACT

An apparatus for fracturing in which: a fracturing tooth is formed so that a base-end portion has a larger diameter than that of a top-end portion, and a tapered part is formed at the base-end portion so as to expand from the top toward the base; a fixing cover is formed along a longitudinal direction of rolls; in the fixing cover, fixing holes for fracturing teeth are formed along the longitudinal direction so that the fracturing tooth is inserted therein; each of the fixing holes has a slope in which the tapered part is in contact at a surface; a fracturing teeth unit is fixed to the roll in a state in which the top-end portion of the fracturing tooth is protruded from the fixing hole radially-outwardly of the roll and the tapered part is wedged between the slope of the fixing hole and the roll.

5 Claims, 7 Drawing Sheets

APPARATUS FOR FRACTURING AND METHOD FOR PRODUCING FRACTURED FRAGMENTS

CROSS REFERENCE TO RELATED APPLICATIONS

This application is related to co-pending application: "APPARATUS FOR FRACTURING AND METHOD FOR PRODUCING FRACTURED FRAGMENTS" filed even date herewith in the name of Motoki Sato, which claims priority to Japanese App. No. 2011-231974, filed Oct. 21, 2011; which application is assigned to the assignee of the present application and is incorporated by reference herein.

BACKGROUND OF THE INVENTION

1. Field of the Invention

The present invention relates to an apparatus for fracturing object into desired size and a method for producing fractured fragments using the same.

Priority is claimed on Japanese Patent Application No. 2011-231975, filed Oct. 21, 2011, the content of which is incorporated herein by reference.

2. Description of Related Art

According to characters of fracturing objects, various apparatuses for fracturing are proposed. For example, in order to fracture polycrystalline silicon for manufacturing single-crystal silicon, apparatuses for fracturing described in the following patent documents 1 to 3 are used:

Patent document 1: Japanese Unexamined Patent Application, First Publication No. 2006-122902

Patent document 2: Published Japanese Translation No. 2009-531172 of the PCT International Publication Patent document 3: Japanese Unexamined Patent Application, First Publication No. 2006-192423

In the patent document 1, a method for obtain silicon fragments by fracturing rod-shaped polycrystalline silicon with a roll-crasher is disclosed. The roll-crasher is a single-roll crasher in which one roll is stored in a housing and a plurality of teeth are formed on a surface of the roll. The roll-crasher fractures the rod-shaped polycrystalline silicon by collapsing between the teeth and an inner surface of the housing so as to impact the polycrystalline silicon continuously.

On the other hand, in the patent documents 2 and 3, apparatuses for fracturing roughly-crashed fragments of polycrystalline silicon are proposed. These apparatuses are double-roll crashers having two rolls and crashing the roughly-crashed fragments of polycrystalline silicon between the rolls.

SUMMARY OF THE INVENTION

Problems to be Solved by the Invention

A maximum target size of fractured fragments obtained from the roll crasher is set as a gap between the roll and the inner surface of the housing of the roll crasher in the patent document 1 or a gap between the rolls of the roll crashers in the patent documents 2 and 3, so that the fracturing object can be fractured into desired size efficiently.

However, since polycrystalline silicon is rigid as a fracturing object, there is a case in which fracturing teeth may be chipped, worn, or broken, so that maximum target size of the fracturing object cannot be controlled and a fracturing efficiency of polycrystalline silicon fracturing into desired size is deteriorated. Furthermore, impurity is generated by an abrasion of the fracturing teeth and immixed into fractured fragments of polycrystalline silicon, thereby causing contamination and acting the quality of the fractured fragments.

The present invention is contrived in view of the circumstances, and an object of the present invention is to provide an apparatus for fracturing and a method for producing fractured fragments using the apparatus for fracturing which can prevent chipping and worn of the fracturing teeth, and obtain high-quality fractured fragments.

Means for Solving the Problem

An apparatus for fracturing according to the present invention includes: a pair of rolls which are rotated in a counter direction each other around parallel axes; and a plurality of fracturing teeth units which are provided on outer peripheral surfaces of the rolls, which are arranged along a circumferential direction of the rolls, and which have a plurality of fracturing teeth protruding radially-outwardly and fixing covers fixing the fracturing teeth on the outer peripheral surfaces of the rolls. In the apparatus for fracturing: each of the fracturing teeth is formed so that a base-end portion has a larger diameter than that of a top-end portion, and a tapered part is formed at the base-end portion so as to expand along a direction from the top-end portion toward the base-end portion; the fixing cover is formed long along a longitudinal direction of the rolls; in the fixing cover, plurality of fixing holes for fracturing teeth are formed so as to be arranged along the longitudinal direction and penetrate the fixing cover along a thickness direction, so that the fracturing tooth is inserted in each of the fixing hole; each of the fixing holes for fracturing teeth has a slope in which the tapered part of the fracturing tooth is in contact at a surface; the fracturing teeth unit is fixed to the roll in a state in which the top-end portion of the fracturing tooth is protruded from the fixing hole for fracturing tooth radially-outwardly of the roll and the tapered part of the fracturing tooth is wedged between the slope of the fixing cover and the roll; and the apparatus fractures fracturing objects between the rolls.

In this apparatus for fracturing, fracturing objects can be fractured efficiently by continuously being impacted by the fracturing teeth while rolling the rolls. In this case, each of the fracturing teeth is formed so that the base-end portion has the larger diameter than that of the top-end portion thereof. Therefore, the fracturing teeth are improved in strength at the contact regions with the fixing cover.

Moreover, the tapered part provided at the thick base-end portion is in contact with the slope of the fixing hole for fracturing tooth of the fixing cover, so that the base-end portion is wedged between the roll and the fixing cover. Therefore, the fracturing tooth is held by being in contact at a surface, so that the impact on the fracturing tooth is received at the broad contact surface. As a result, the stress can be prevented from concentrating at the base-end portion of the fracturing tooth, so that the breakage or the like of the fracturing tooth can be prevented.

In the apparatus for fracturing according to the present invention, it is preferable that a conical column part be formed by extending the tapered part between the top-end portion and the base-end portion of the fracturing tooth.

In this case, since the tapered part of the base-end portion and the column part are continuously formed conically, the stress can be prevented from concentrating at the connected part of the tapered part with the column part, so that the chipping or worn of the fracturing teeth can be prevented.

The tapered part of the base-end portion may be provided with different angle from that of the column part. In this case, the column part that is exposed from the fixing cover while fracturing can be formed by selecting the shape suitable for fracturing; and the tapered part can be formed by selecting the angle suitable for holding the fracturing tooth.

In the apparatus for fracturing according to the present invention, it is preferable that an inclined angle of the tapered part be set in a range of not less than 10° and not more than 25° with respect to a normal line at the outer peripheral surface of the roll.

If the inclined angle of the tapered part is less than 10°, the fracturing tooth is easy to fall out from the fixing cover. If the inclined angle of the tapered part is more than 25°, the stress is concentrated at the connected part of the column part with the tapered part, so that breakages are easy to occur. Furthermore, as the inclined angle is increased, the diameter of a bottom surface (an end surface of the base-end portion) of the fracturing tooth is expanded, so that the fracturing teeth should be arranged with wide pitch along the circumferential direction of the roll. Therefore, it is difficult to control the size of the fractured fragments which are obtained by fracturing the fracturing object to a desired size.

In the apparatus for fracturing according to the present invention, it is preferable that both ends of the fixing cover of the fracturing teeth unit be fixed to the roll by screws, and a flat part be formed on the outer peripheral surface of the roll in which back surfaces of the both ends of the fixing cover are in contact with.

If the outer peripheral surface of the roll at the fixing part of the screws for the fixing cover is formed cylindrical, bending stress is generated on the screws fixing the fixing cover. However, since the fixing cover and the roll are in contact with each other at surfaces, the fixing cover is stabilized and the breakage or the like thereof can be prevented.

A method for producing fractured fragments according to the present invention produces the fractured fragments by using one of the apparatuses for fracturing described above.

Effects of the Invention

According to the present invention, since the fracturing tooth has the tapered part at the base-end portion, the tapered part is wedged between the fixing cover and the roll so as to be held by being in contact at a surface, the impact on the fracturing tooth can be received at the broad contact surface. Therefore, the stress concentrating at the base-end portion of the fracturing tooth can be reduced, so that chipping and worn of the fracturing tooth can be prevented and high-quality fractured fragments can be obtained.

DESCRIPTION OF THE PREFERRED EMBODIMENTS

Hereinafter, an apparatus for fracturing and a method for producing fractured fragments according to the present invention will be described with reference to the drawings in respect of an apparatus for fracturing polycrystalline silicon and a method for producing fractured fragments of polycrystalline silicon.

Figure 1:
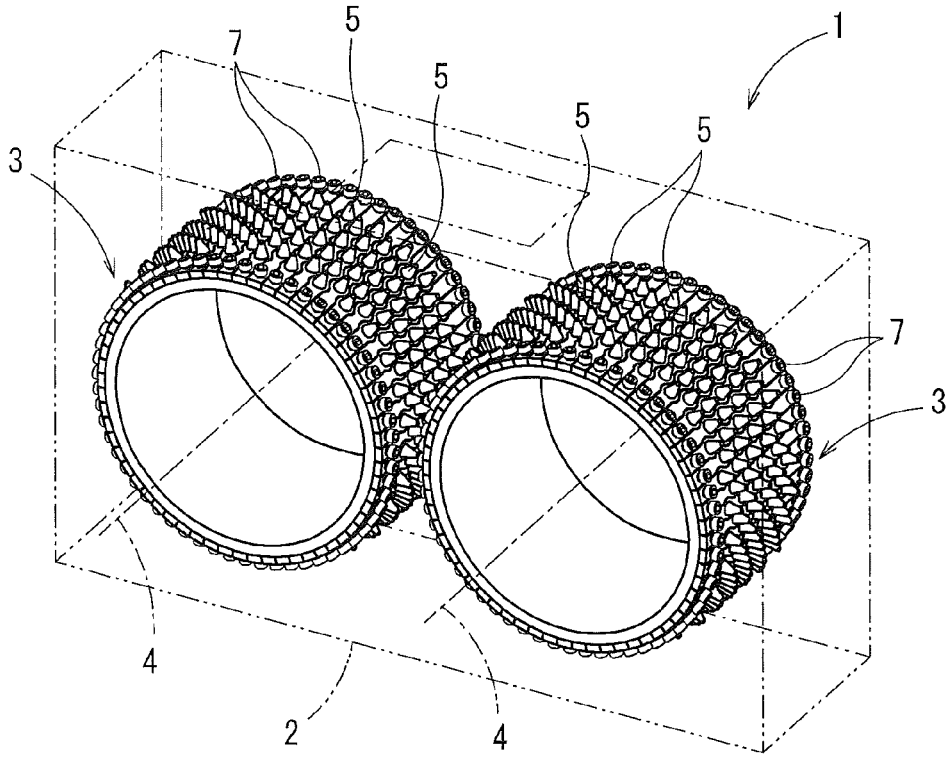
FIG. 1 is a perspective view showing an embodiment of an apparatus for fracturing according to the present invention.
Figure 2:
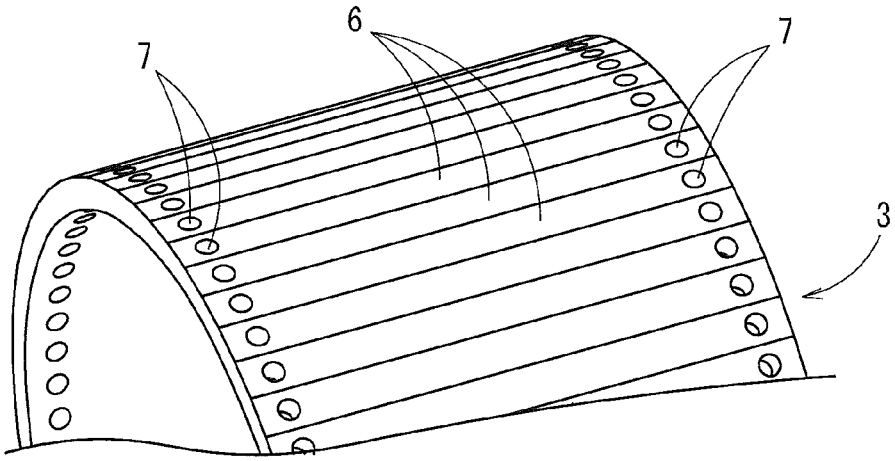
FIG. 2 is a perspective view showing a surface of a roll in the apparatus for fracturing shown in FIG. 1.

As shown in FIG. 1, an apparatus 1 for fracturing polycrystalline silicon (hereinafter, "the fracturing apparatus 1") of the present embodiment is provided with two rolls 3 which are arranged in a housing 2 so that axes 4 are horizontal and parallel with each other. A plurality of fracturing teeth 5 are provided on an outer peripheral surface of both the rolls 3 so as to protruding radially-outwardly. As shown in FIG. 2, the outer peripheral surfaces of the rolls 3 are not even circular surface, but are formed as a polyhedral shape configured from long flat parts 6 which are elongated along the axis direction and are connected along a circumferential direction. Threaded holes 7 are formed at both ends of the flat part 6. On each of the flat parts 6, a fracturing teeth unit 8 is fixed.

Figure 3:
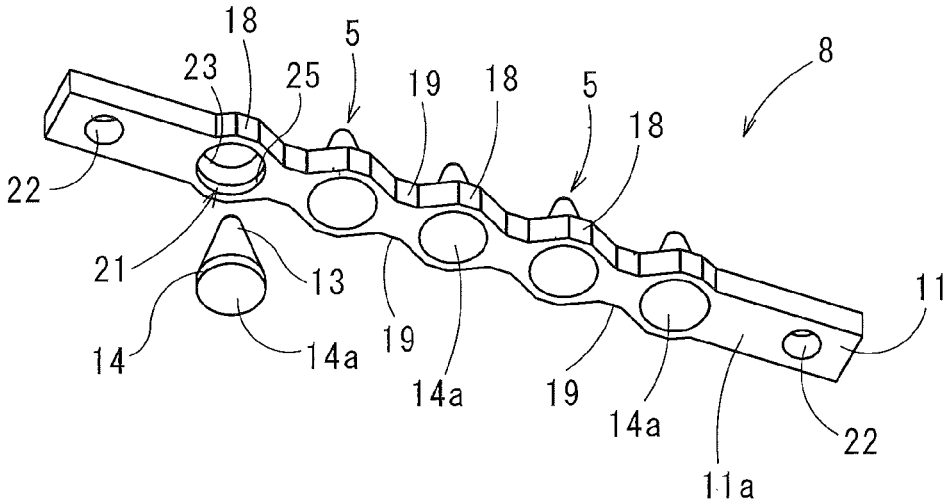
FIG. 3 is a perspective view showing a fracturing teeth unit viewed from a back surface, which is provided with the apparatus for fracturing.
Figure 4:
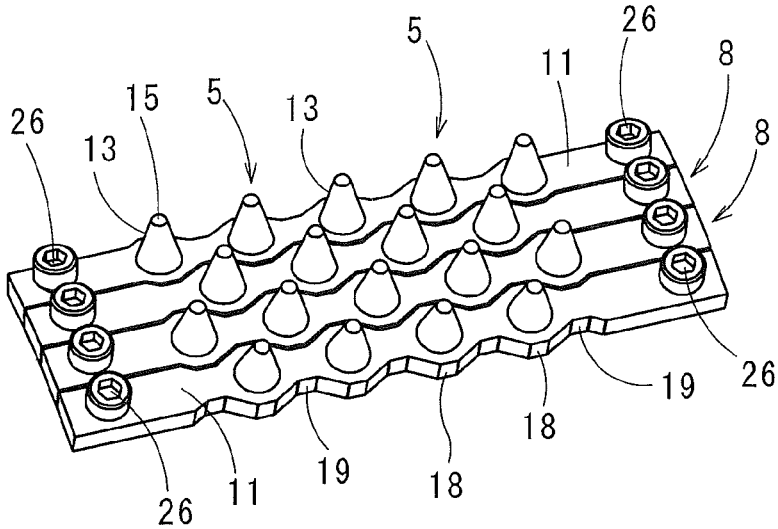
FIG. 4 is a perspective view showing the fracturing teeth units which are arranged.

The fracturing teeth unit 8 is provided with a long fixing cover 11 which is in contact with the flat part 6 of the roll 3, and the plurality of fracturing teeth 5 which are fixed to the fixing cover 11 as shown in FIG. 3 and FIG. 4.

Figure 5A:
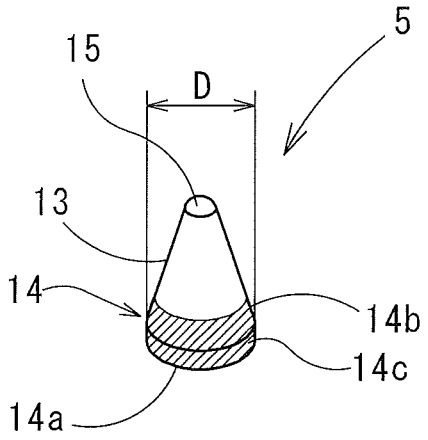
FIG. 5A is a perspective view showing the fracturing tooth.
Figure 5B:
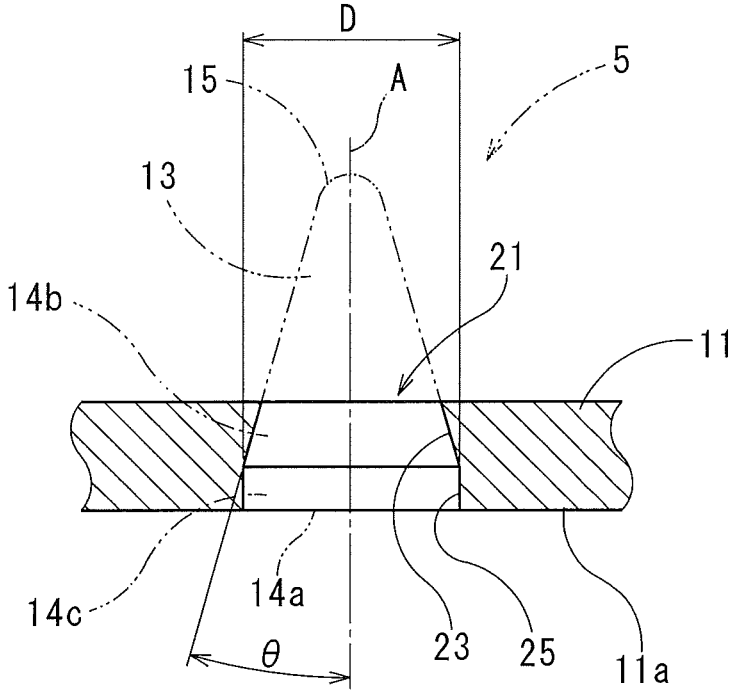
FIG. 5B is an enlarged sectional view showing an essential portion of the fracturing teeth unit.

The fracturing tooth 5 is, as shown in FIGS. 5A and 5B, formed from cemented carbide or silicon material so as to have a larger diameter at a base-end portion 14 than that of a top-end portion 15. The top-end portion 15 of the fracturing tooth 5 is formed spherically. A side surface of a column part 13 connecting the top-end portion 15 and the base-end portion 14 is formed conically expanding from the top-end portion 15 to the base-end portion 14.

A tapered part 14*b* is formed conically by extending the side surface of the column part 13 on the base-end portion 14 so as to expand along a direction from the top-end portion 15 to the base-end portion 14. A bottom part 14*c* positioned at a bottom of the base-end portion 14 is formed cylindrically; and a bottom surface 14*a* of the base-end portion 14 is formed as a flat plane crossing a longitudinal direction of the fracturing tooth 5.

Figure 6:
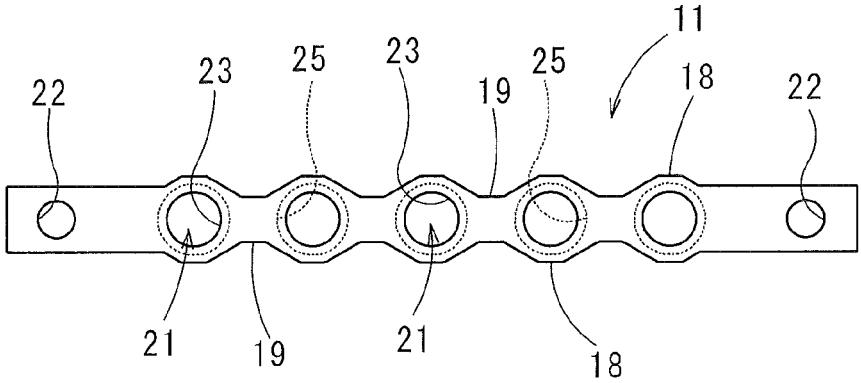
FIG. 6 is a front view showing a fixing cover of the fracturing teeth unit.

The fixing cover 11 is formed long having the same width and the same length as that of the flat part 6 of the roll 3. In the fixing cover 11, as shown in FIG. 6, a plurality of fixing holes 21 for fracturing teeth are formed with intervals along the longitudinal direction of the fixing cover 11 so as to penetrate the fixing cover 11, expanded parts 18 are formed by expanding side edges of both side parts of the fixing hole 21 for fracturing tooth, and an indented part 19 is formed by narrowing a part between the fixing holes 21 for fracturing teeth with respect to the expanded part 18. Through-holes 22 for screw are formed at both ends of the fixing cover 11.

In the fixing cover 11 shown in FIG. 6, side surfaces of the expanded parts 18 and the indented parts 19 are formed parallel to the longitudinal direction of the fixing cover 11, and are gradually connected with each other.

As shown in FIGS. 3 and 5B, the fixing hole 21 for fracturing tooth is formed so that a half depth thereof is a conical slope (an engaging-hole part) 23 corresponding to the tapered part 14*b* of the fracturing tooth 5, and the other half depth thereof is an expanded-hole part 25 corresponding to the bottom part 14*c*. Accordingly, the fracturing tooth 5 is held in a state in which the tapered part 14*b* is in contact with the slope of the engaging-hole part 23 and the bottom part 14*c* is engaged with the expanded-hole part 25.

In this case, the fixing cover 11 is mounted on the flat part 6 of the roll 3 with setting the expanded-hole parts 25 toward the surface of the roll 3 and is fixed on the surface of the roll 3 at the both ends by screws 26 in a state in which the column part 13 of the fracturing tooth 5 is protruded from the engaging-hole part 23. In this state, the fracturing tooth 5 is wedged between the fixing cover 11 and the surface of the roll 3 in a state in which the tapered part 14*b* of the base-end portion 14 is in contact at surface with the slope of the engaging-hole part 23. Furthermore, in this state, the bottom surface 14*a* of the base-end portion 14 of the fracturing tooth 5 is in contact at a surface with the flat part 6 of the outer peripheral surface of the roll 3, and a flat back surface 11*a* of the fixing cover 11 is also in contact at a surface with the flat part 6 of the roll 3.

In the fracturing teeth unit 8 as constructed above, an inclined angle θ of the tapered part 14*b* formed at the base-end portion 14 of the fracturing tooth 5 is set in a range of not less than 10° and not more than 25° with respect to a normal line A at the outer peripheral surface of the roll 3 (refer to FIG. 5B).

If the inclined angle θ of the tapered part 14*b* is less than 10°, the fracturing tooth 5 is easy to fall out from the fixing cover 11. On the other hand, if the inclined angle θ of the tapered part 14*b* is more than 25°, the fracturing tooth 5 is easy to be broken since the stress is concentrated at the connected part of the column part 13 with the tapered part 14*b*. Furthermore, as the inclined angle θ of the tapered part 14*b* is increased, the diameter of the bottom surface 14*a* of the fracturing tooth 5 is expanded, so that the fracturing teeth 5 should be arranged with wide pitch along the circumferential direction of the roll 3. Therefore, it is difficult to control the size of the fractured fragments which are obtained by fracturing object to a desired size.

The fracturing teeth units 8 are arranged so that the fracturing teeth 5 of the adjacent fracturing teeth units 8 are not rowed along the circumferential direction of the roll 3 and so that the fracturing teeth 5 are arranged in a staggered manner as shown in FIG. 4. The fracturing teeth units 8 are attached so that the indented part 19 of the fixing cover 11 is engaged to the expanded part 18 of the adjacent fixing cover 11.

Figure 7:
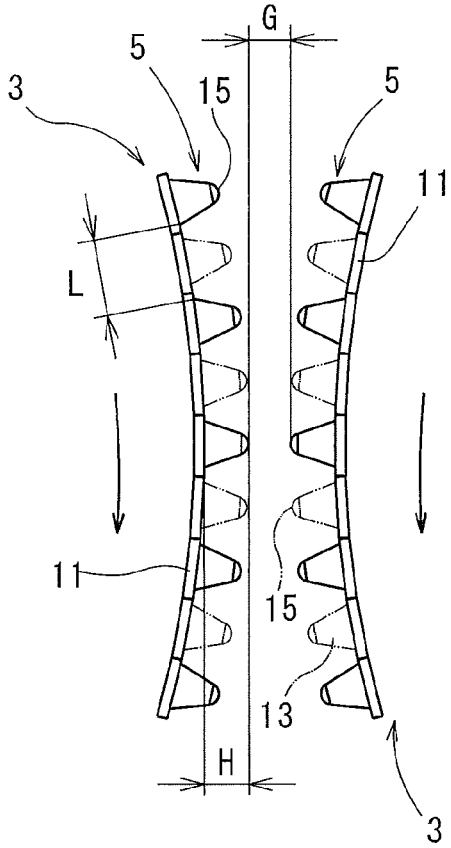
FIG. 7 is a front view showing a positional relation of rolls at a facing part.
Figure 8A:
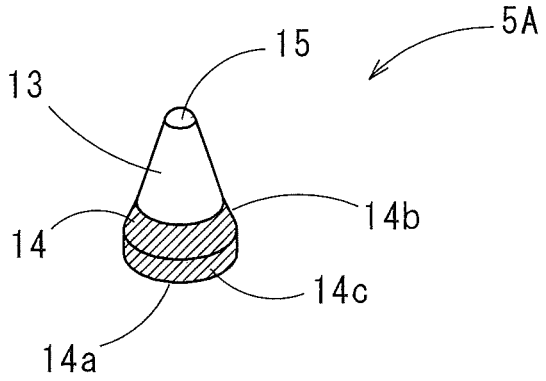
FIG. 8A is a perspective view of a fracturing tooth of another example.
Figure 8B:
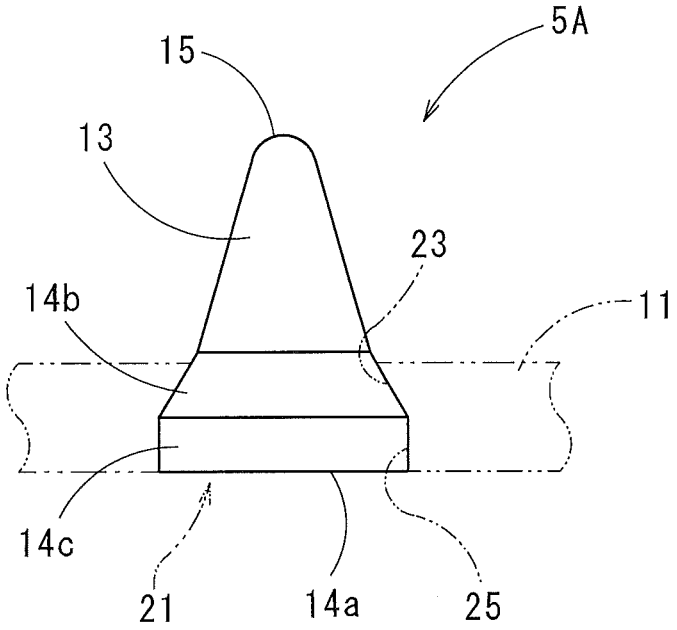
FIG. 8B is an enlarged sectional view of an essential portion of a fracturing teeth unit.
Figure 9A:
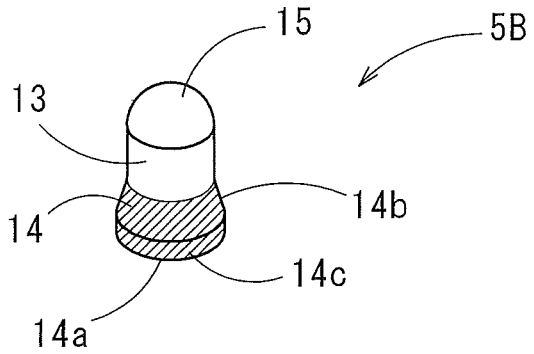
FIG. 9A is a perspective view showing a fracturing tooth of another example.
Figure 9B:
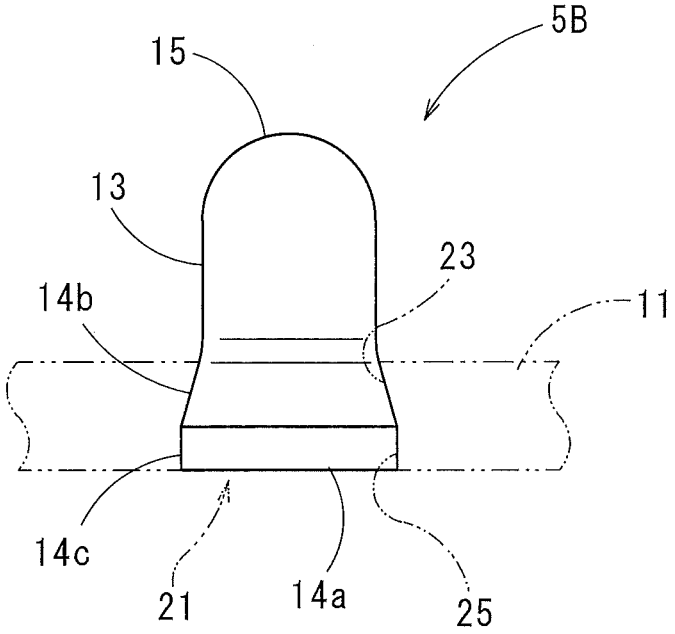
FIG. 9B is an enlarged sectional view of an essential portion of a fracturing teeth unit.

On the other hand, as shown in FIG. 7, the rolls 3 are arranged so that the top-end portions 15 of the fracturing teeth 5 on each of the rolls 3 face each other at the facing part of the rolls 3 (i.e., the fracturing teeth 5 of each rolls 3 are closest approached with each other).

In FIG. 7, among the staggered fracturing teeth 5, the fracturing teeth 5 arranged in a same circumferential row are denoted by continuous lines, and the fracturing teeth 5 arranged in the other circumferential row are denoted by two-dot lines.

In this embodiment, target size of fragment of polycrystalline silicon after fracturing is set in a range of 5 mm to 60 mm in maximum length. In order to obtain the fragments of such size, a diameter D of the column part 13 of the fracturing tooth 5 is set in a range of 16 mm to 22 mm, a protruding height H of the fracturing tooth 5 from the surface of the fixing cover 11 to the tip of the fracturing tooth 5 shown in FIG. 7 is set in a range of 15 mm to 25 mm, and a gap L between the adjacent fracturing tooth 5 is set in a range of 11 mm to 32 mm. Also, at the facing part of the rolls 3, a facing distance G between the top-end portions 15 of the fracturing teeth 5 is set in a range of 5 mm to 30 mm.

The housing 2 in which the rolls 3 are set is formed of resin such as polypropylene or the like, or formed of metal having an inner coating of tetrafluoroethylene in order to prevent contamination.

When fractured fragments of polycrystalline silicon is produced by using the fracturing apparatus 1 configured as described above, in a state of rolling the rolls 3, by supplying roughly-fractured polycrystalline silicon of appropriate size between the rolls 3, the fragments of polycrystalline silicon are further fractured into fragments between the fracturing teeth 5 of the rolls 3.

The base end part 14 of the fracturing tooth 5 is formed so as to have the larger diameter than that of the top-end portion 15, and the tapered portion 14*b* of the base-end portion 14 is formed conically by extending the side surface of the column part 13, so that the strength of the fracturing tooth 5 at the contact region with the fixing cover 11 is increased. The fracturing tooth 5 is held at the surface by wedging the tapered part 14*b* provided at the thick base-end portion 14 between the roll 3 and the fixing cover 11 in a state in which the tapered part 14*b* is in contact with the slope of the engaging-hole part 23 of the fixing hole 21, so that the impact on the fracturing tooth 5 can be received at the whole contact surface. Therefore, the stress concentration at the base-end portion 14 of the fracturing tooth 5 can be reduced, so that the chipping or worn of the fracturing tooth 5 can be prevented. Moreover, since the connected part of the tapered part 14*b* with the column part 13 is formed as a continuous conical-shape, the connected part can be prevented from concentrating of the stress.

The tapered part 14*b* of the base-end portion 14 may be formed so as to have a different angle from that of the side surface of the column part 13 as modified examples shown in FIGS. 8A, 8B, 9A and 9B. A fracturing tooth 5A shown in FIGS. 8A and 8B has a combination shape of the tapered part 14*b* of the base-end portion 14 and the side surface of the column part 13 having different angles from each other. In a fracturing tooth 5B shown in FIGS. 9A and 9B, the side surface of the column part 13 is formed cylindrically. Also in these cases, since the base-end portion 14 has the larger diameter than that of the top-end portion 15, the strength at the contact region of the fixing cover 11 can be increased enough. In the column part 13 protruded from the fixing cover 11 while fracturing, the shape of the side surface can be selected suitable for fracturing. In the tapered part 14*b*, a slope having a suitable angle for holding the fracturing tooth can be selected.

In the fixing cover 11, the expanded part 18 is formed by expanding the side edges of both the side parts of the fixing hole 21 holding the thick base-end portion 14; and the indented part 19 is formed between the expanded parts 18. By engaging the expanded part 18 and the indented part 19 of the adjacent fixing covers 11, the fracturing teeth 5 are arranged in the staggered manner, and the contact surface of the adjacent fixing covers 11 is formed in a saw-toothed shape with respect to the longitudinal direction of the fixing cover 11, so that the contact area thereof is increased and the fixing covers 11 are supported with each other. As a result, the fracturing teeth 5 are prevented from being chipped or worn and the fixing covers 11 are prevented from being deformed even when the fracturing teeth 5 are loaded.

The fracturing tooth 5 is in contact at the bottom surface 14*a* of the base-end portion 14 with the flat part 6 of the roll 3, so that the impact by fracturing can be received at the whole contact surface, and the fracturing tooth 5 is necessarily stable. Therefore, the fracturing tooth 5 is prevented from being shaken, so that uniformly-sized fractured fragments can be stably produced.

Since the back surface 11*a* of the fixing cover 11 is in contact at a surface with the flat part 6 of the roll 3, also the fixing cover 11 is prevented from being shaken by the impact of the fracturing teeth 5. Therefore, bending moment or the like does not act on the screws 26 fixing the fixing cover 11 to the roll 3, so that strong fixation structure can be maintained, and the fixing cover 11 can be prevented from breakage or the like.

The expanded part 18 of the fixing cover 11 is formed wide along the circumferential direction of the roll 3, so that the fracturing teeth 5 fall hard. Therefore, the fracturing tooth 5 is prevented from being shaken, so that the uniformly-sized fractured fragments can be stably produced.

Furthermore, by arranging the fracturing teeth 5 in the staggered manner, even though the fracturing tooth 5 is formed so as to be radially expanded at the base-end portion 14 thereof, the fracturing teeth 5 can be arranged without expanding the pitch along the circumferential direction of the roll 3, and the fractured fragments obtained by fracturing the fracturing object can be controlled in desired size.

In the fracturing teeth 5, the top-end portions 15 are formed spherically, so that the top-end portions 15 and polycrystalline silicon are in contact at points. Also, in the fracturing teeth 5, the side surfaces of the column parts 13 are formed conically, so that the side surfaces and polycrystalline silicon are in contact at points or in lines. Therefore, the fracturing teeth 5 impact polycrystalline silicon by being in contact with at points or in lines, so that polycrystalline silicon can be prevented from being crushed by planes.

Furthermore, in the fracturing apparatus 1, since the fracturing teeth 5 are formed from cemented carbide or silicon material, impurities are prevented from contaminating polycrystalline silicon from the fracturing teeth 5. Moreover, the housing 2 is made from resin such as polypropylene or the like, or is coated by tetrafluoroethylene, so that polycrystalline silicon can be prevented from being contaminated by impurities while fracturing. As a result, according to the fracturing apparatus 1, high-quality polycrystalline silicon for semiconductor material can be obtained.

Furthermore, in the present embodiment, the fracturing teeth units 8 in which the fixing cover 11 holds the fracturing teeth 5 independently with each other are fixed on the surface of the rolls 3. Therefore, when some fracturing teeth 5 are fallen or chip away, it is sufficient to replace the defective fracturing teeth 5. In this case, since the fracturing teeth units 8 are fixed to the rolls 3 by the screws 26, and the fracturing teeth 5 are only fitted into the fixing holes 21 for fracturing teeth of the fixing cover 11 and wedged between the fixing cover 11 and the surface of the roll 3, it is easy to replace some of the fracturing teeth 5.

It is preferable that the fixing cover 11 be made of stainless steel or the like in order to maintain strength. Also, by coating the surface of the fixing cover 11 by resin such as polypropylene, tetrafluoroethylene or the like, contamination can be prevented even though a surface of the fixing cover 11 is in contact with polycrystalline silicon.

The present invention is not limited to the above-described embodiments and various modifications may be made without departing from the scope of the present invention.

For example, the top surfaces of the fracturing teeth are faced each other at the facing part of the rolls in the above embodiment. However, the fracturing teeth of the roll may be arranged so as to be faced to gaps between the fracturing teeth of the other roll.

Figure 10:
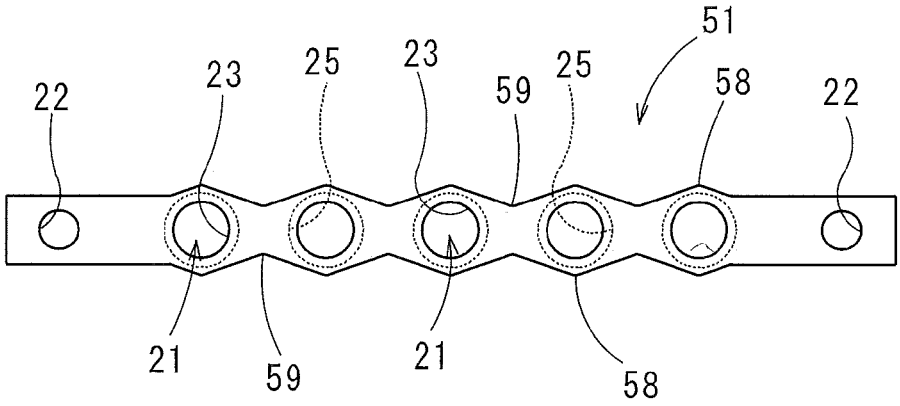
FIG. 10 is a front view showing a modified example of the fixing cover of the fracturing teeth unit.

Also, dimensions of the facing gaps or the like of the fracturing teeth are not limited to the above-described embodiments. In the above embodiment, side surfaces of the expanded parts 18 are formed parallel to the longitudinal direction of the fixing cover 11. However, the side surfaces of the expanded part may be formed only by oblique surfaces to the longitudinal direction without a parallel portion so as to have one apex, as expanded parts 58 of a fixing cover 51 shown in FIG. 10. Also, indented parts 59 may be formed by oblique surfaces to the longitudinal direction without a parallel surface so as to have one apex.

The fracturing apparatus of the present invention is not limited for fracturing polycrystalline silicon, but can be applied for fracturing plastics, glass or the like.

What is claimed is:

1. An apparatus for fracturing comprising:

a pair of rolls which are rotated in a counter direction each other around parallel axes; and a plurality of fracturing teeth units which are provided on outer peripheral surfaces of the rolls, which are arranged along a circumferential direction of the rolls, and which have a plurality of fracturing teeth protruding radially-outwardly and fixing covers fixing the fracturing teeth on the outer peripheral surfaces of the rolls, wherein each of the fracturing teeth is formed so that a base-end portion has a larger diameter than that of a top-end portion, and a tapered part is formed at the base-end portion so as to expand along a direction from the top-end portion toward the base-end portion, each of the fixing covers is formed long along a longitudinal direction of the rolls, in each of the fixing covers, plurality of fixing holes for fracturing teeth are formed so as to be arranged along the longitudinal direction and penetrate each of the fixing covers along a thickness direction, so that the fracturing tooth is inserted in each of the fixing holes, each of the fixing holes for fracturing teeth has a slope in which the tapered part of the fracturing tooth is in contact at a surface, the fracturing teeth unit is fixed to the roll in a state in which the top-end portion of the fracturing tooth is protruded from the fixing hole for fracturing tooth radially-outwardly of the roll and the tapered part of the fracturing tooth is wedged between the slope of each of the fixing covers and the roll, and the apparatus fractures fracturing objects between the rolls.

2. The apparatus for fracturing according to claim 1, wherein a conical column part is further formed by extending the tapered part between the top-end portion and the base-end portion of the fracturing tooth.

3. The apparatus for fracturing according to claim 1, wherein an inclined angle of the tapered part is set in a range of not less than 10° and not more than 25° with respect to a normal line at the outer peripheral surface of the roll.

4. The apparatus for fracturing according to claim 1, wherein:

both ends of each of the fixing covers of the fracturing teeth unit are fixed to the roll by screws; and a flat part is formed on the outer peripheral surface of the roll in which back surfaces of the both ends of each of the fixing covers are in contact with.

5. A method for producing fractured fragments by using the apparatus for fracturing according to claim 1.

* * * * *